US005619930A

United States Patent [19]

Alimanestiano

[11] Patent Number: 5,619,930

[45] Date of Patent: Apr. 15, 1997

[54] HIGH SPEED TRANSPORTATION SYSTEM

[76] Inventor: Constantin Alimanestiano, 2015 Blowing Rock Rd., Boone, N.C. 28607

[21] Appl. No.: 569,910

[22] Filed: Dec. 8, 1995

Related U.S. Application Data

[63] Continuation-in-part of Ser. No. 314,283, Sep. 30, 1994, abandoned.

[51] Int. Cl.[6] ..... B61B 13/10

[52] U.S. Cl. ..... 104/138.1; 104/28; 105/216; 105/365; 105/377.01

[58] Field of Search ..... 104/138.1, 28, 104/35; 105/3, 61.5, 216, 355, 365, 377.05, 377.06, 377.01; 410/3, 4, 30

[56] References Cited

U.S. PATENT DOCUMENTS

| | | | |
|---|---|---|---|
| 2,511,979 | 6/1950 | Goddard | 104/138.1 |
| 3,009,426 | 11/1961 | Nampa | 105/377.05 |
| 3,213,802 | 10/1965 | Foa | 104/138.1 |
| 3,285,194 | 11/1966 | Clejan | 410/4 |
| 3,329,096 | 7/1967 | McGovern | 104/138.1 |
| 4,062,295 | 12/1977 | Hammann | 105/216 |
| 4,066,021 | 1/1978 | Heim | 104/138.1 |
| 4,455,119 | 6/1984 | Smith | 410/30 |
| 4,641,587 | 2/1987 | Dallard | 105/3 |
| 5,271,334 | 12/1993 | Sweet et al. | 104/102 |
| 5,460,098 | 10/1995 | Jackson et al. | 104/138.1 |

*Primary Examiner*—S. Joseph Morano
*Attorney, Agent, or Firm*—Aquilino & Welsh

[57] ABSTRACT

A transportation system for transporting vehicles between destinations, including a self-supporting tunnel connecting automated loading and unloading yards, and a non-wheeled tubular vehicle including a ram drive. The vehicle is provided with anti-friction pads between the vehicle and the tunnel, enabling the vehicle to be pushed with a minimum of friction through the tunnel. The pads include an expansion and contraction mechanism for regulating the position of the pads relative to an inner surface of the tunnel. The system uses a jet-powered drive vehicle controlled by an operator to transport a plurality of vehicles interconnected by a coupling apparatus. The vehicles may transport automobiles or passengers. The automobile transport vehicles include an automatic wheel locking system having front bars and caps, all automatically operated to secure the vehicles in the capsules during transportation thereof.

20 Claims, 16 Drawing Sheets

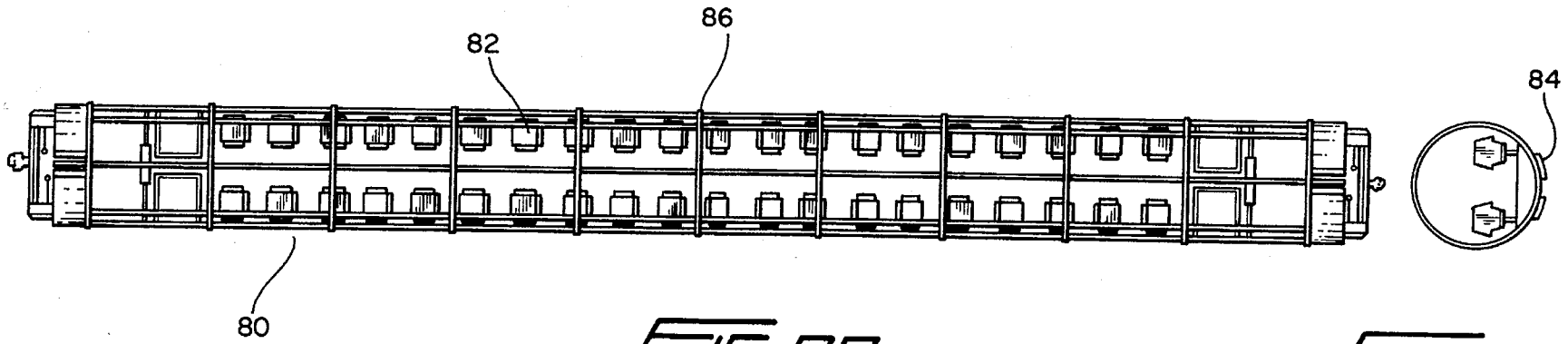
FIG. 24
FIG. 23
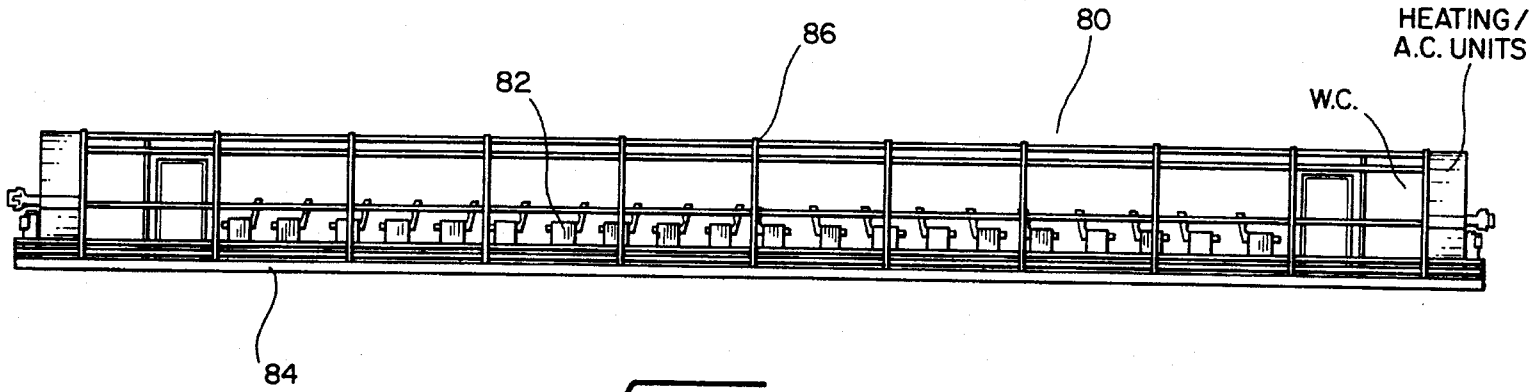
FIG. 22

HIGH SPEED TRANSPORTATION SYSTEM

This is a Continuation-In-Part of application Ser. No. 08/314,283 filed on Sep. 30, 1994, now abandoned.

BACKGROUND OF THE INVENTION

The present invention relates to a high speed transportation system and in particular to a system using a plurality of capsules for transporting people and vehicles using a ram drive vehicle to propel the capsules through a lattice-like tunnel between destinations.

Saturation of highways and the relative shortcomings of public transportation systems such as planes, railroads and buses call for new innovations in transportation in order to keep up with the constantly increasing number of travelers. Costs of adding to the interstate highway system and the costs for new railway and subway systems have become prohibitive.

Motor vehicle systems have a distinct advantage of permitting a driver and the contents of the vehicle to be selectively moved from location to location without any encumbrances such as time schedules, travel corridors and the like. However, the increasing number of motor vehicles has clogged the highway system causing numerous delays and traffic jams and wear and tear on the highways. Moreover, many motor vehicles are driven with only a single driver, thus, there is great inefficiency in the motor vehicle system which do not always counteract the convenience of a single vehicle, particularly when the question of fuel economy and other environmental questions are considered. There have been some initial efforts to overcome these disadvantages. For example, auto trains transport motor vehicles from one location to another thereby enabling a driver to have his own vehicle once the destination is reached without having to physically drive the vehicle across great distances to reach the destination.

Other high speed transportation systems are known in the prior patent art and whereas these systems have some advantages, none have been found to be efficient enough or practical enough to be used on a wide scale basis.

SUMMARY OF THE INVENTION

The present invention is an inexpensive, fast and very safe transportation system for people with or without their automobiles for traveling between destinations. The system in accordance with the present invention is estimated to cost a fraction of the average cost of various people mover transportation systems currently being proposed including high speed rail systems and highways.

The transportation system of the present invention can run on solid land, through wetlands, hills or even mountains. Preferably, the system would run along side interstate highway or other similar right of way systems. People would drive their automobiles or other vehicles to a terminal yard located outside a particular destination such as a town or city, preferably having a major access route such as a main thoroughfare or interstate highway. At the terminal, guided by suitable electronic signals, people will drive their cars into special vehicles or capsules designed to operate with the system. Once the vehicles or capsules are filled, a ground operator will, by remote control, close the capsules, align them from a parking position to a travel position and form a train. The ram drive vehicle will then push the train into a lattice-like tunnel and propel the train to a remote destination at speeds reaching 550 miles per hour.

The capsules do not have wheels and are designed to be propelled through a self-supporting tunnel. The capsules are formed by an open lattice-work structure with large openings on the side, a continuous bottom, continuous side strips and a continuous top. The capsules are provided the anti-friction pads to facilitate their movement through the tunnel. Each capsule is provided with a coupler system which is rotatable and operated by remote control by the operator in the ram drive vehicle.

The tunnel is made with a slightly larger diameter than the capsules. The system uses a transfer yard for loading, positioning the transfer of the capsule from ground level into the tunnel. When arriving at a destination, a similar transfer yard operates in reverse sequence enabling the vehicles to be unloaded and driven to the final destination by the user.

Among the objects of the present invention is the provision of a high-speed transportation system which provides door-to-door or location-to-location passenger transportation.

Another object of the present invention is a transportation system which enables a passenger to have the use of his own vehicle when he reaches his destination without the necessity of driving the vehicle to that destination.

Still another object of the present invention is to provide a transportation system with a guided ride in an enclosed tunnel which will promote increased safety by preventing track accidents and/or collisions.

Still a further object of the present invention is to provide a transportation system with reduced air pollution and increased efficiency enabling the movement of a large number of automobiles over great distances without engine pollution.

Yet another object of the present invention is to increase the driving range of electric automobiles, which curb pollution, by transporting them long distances between cities, enabling them to be efficiently used within the cities between charges.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 22 is a side elevational view of a passenger capsule of the transportation system of the present invention.

FIG. 23 is a top plan view of the passenger capsule of FIG. 22.

FIG. 24 is an end view of the capsule of FIG. 22.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
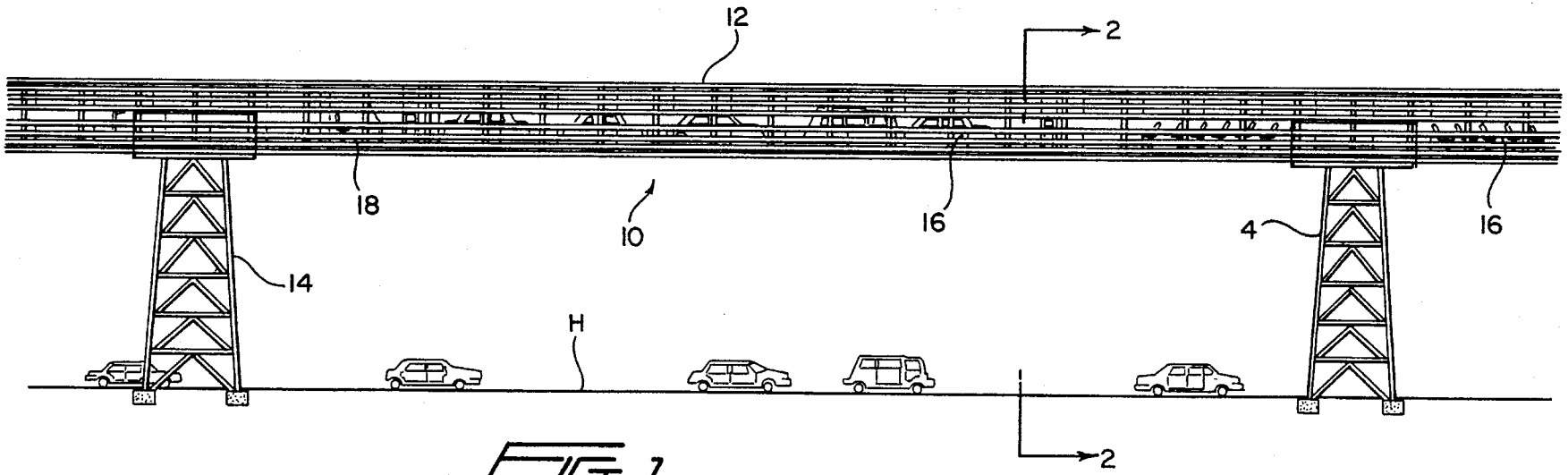
FIG. 1 is a side elevational view of the transportation system of the present invention adjacent to a highway.
Figure 2:
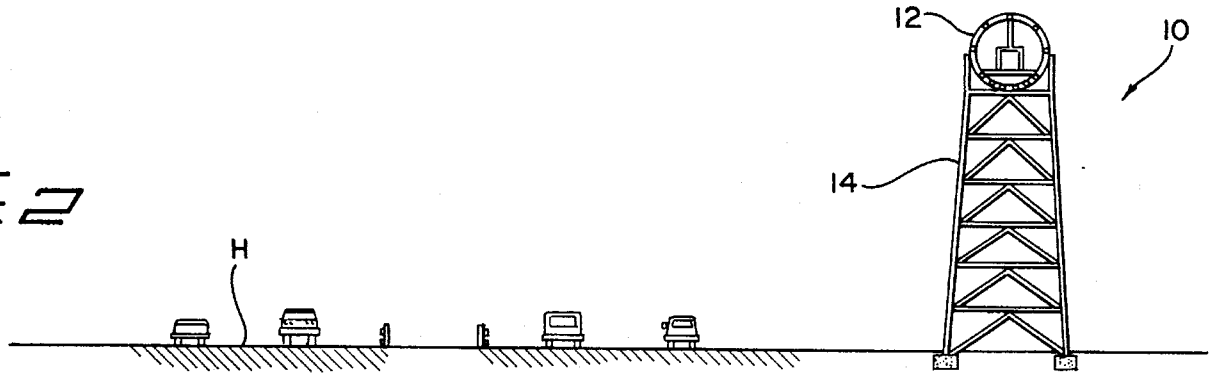
FIG. 2 is an end sectional view taken along line 2—2 of FIG. 1.
Figure 5:
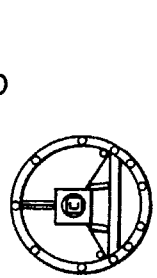
FIG. 5 is an end view of the capsule of FIG. 3.
Figure 4:
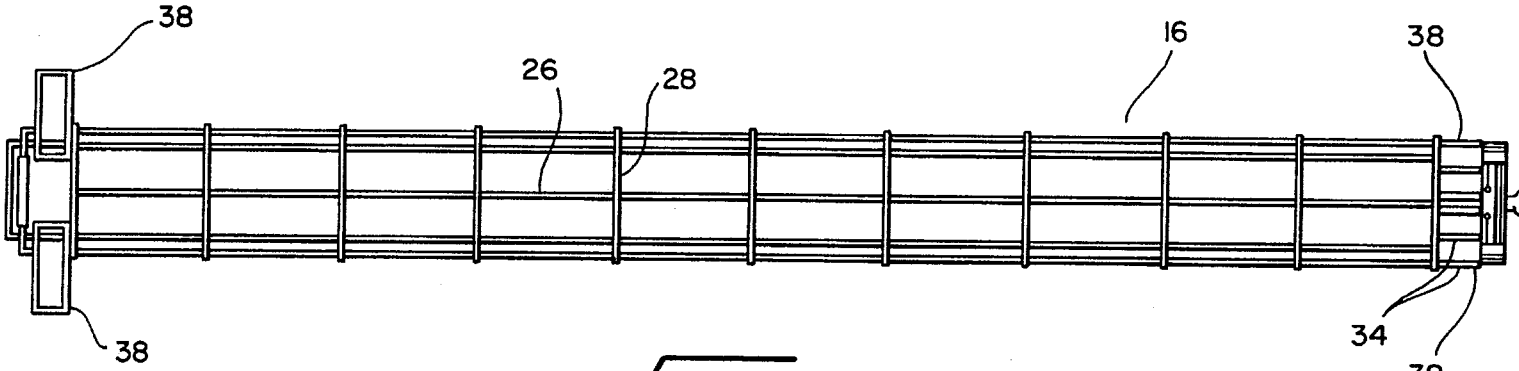
FIG. 4 is a top plan view of the capsule of FIG. 3.
Figure 3:
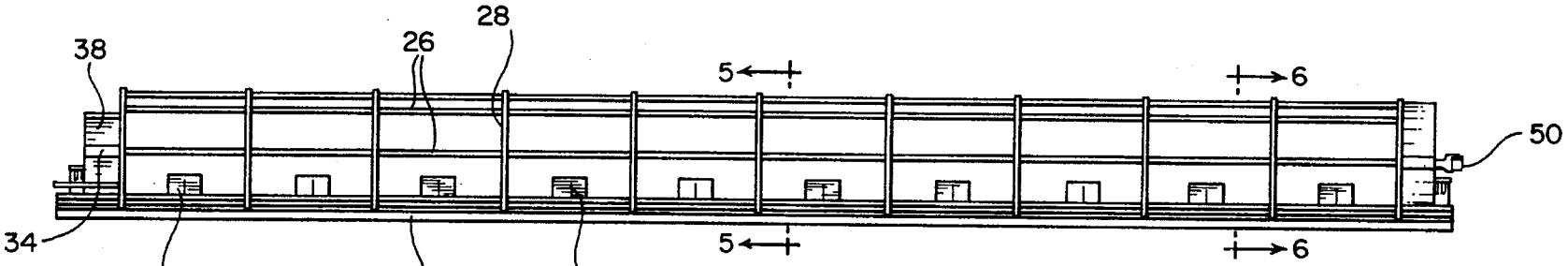
FIG. 3 is a side elevational view, of a transportation capsule of the present invention.
Figure 7:
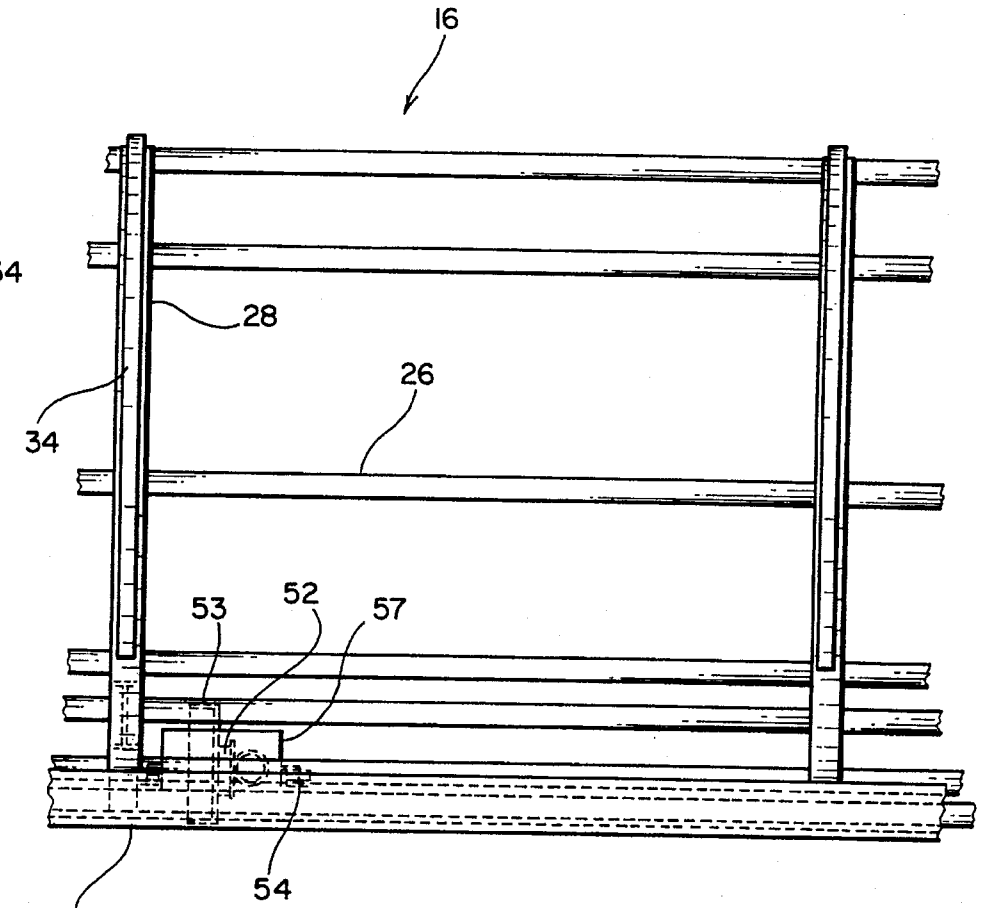
FIG. 7 is an enlarged view of a detail of FIG. 3.
Figure 6:
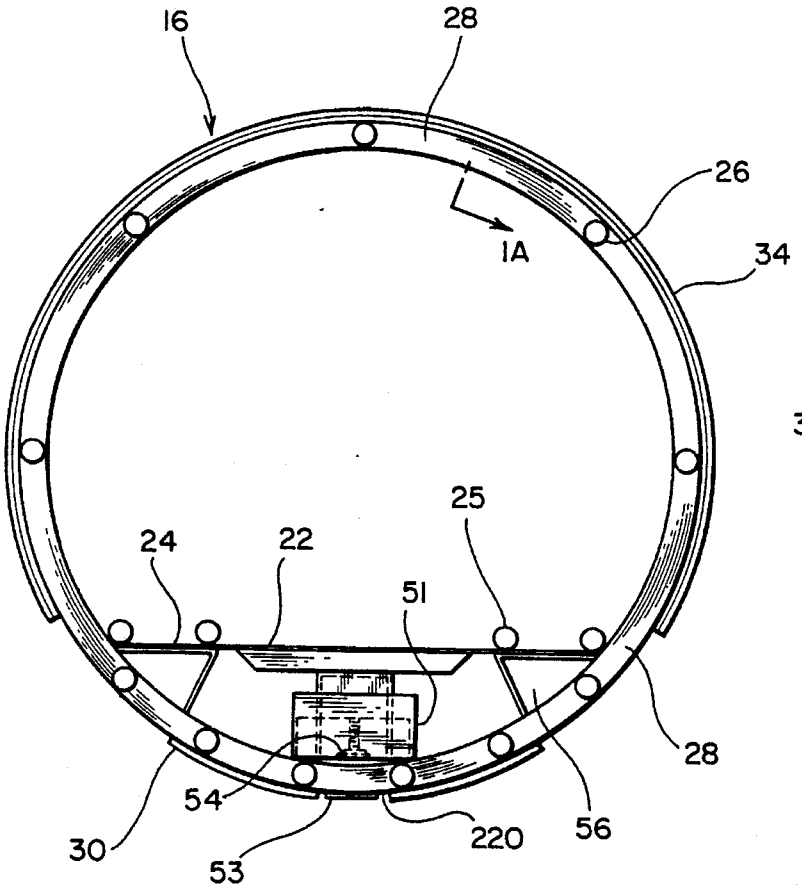
FIG. 6 is a detailed sectional view taken along lines 6—6 of FIG. 3.

FIGS. 1 and 2 show side and end elevational views of a transportation system in accordance with the present invention. Preferably, the system 10 would be located adjacent to an interstate highway H. The system 10 includes an elongated lattice-like tunnel 12 preferably mounted on pylons 14. The tunnel 12 is structured as described in detailed herein below to support a series of capsules 16 which are designed to transport motor vehicles and/or passengers. The series of capsules 16 will form a train driven by a ram drive vehicle 18.

Referring to FIGS. 3–7, the structure of the capsule 16 is described with greater detail. The capsule is cylindrical in shape. The capsule 16 is made with a fabricated steel floor 22. secured to inner surfaces of the capsule 16 by braces 56. The outer sections 24 of the floor 22 are separated by longitudinal barriers 25 and position the wheels of vehicles being transported in the capsule 16. It will be appreciated that the width of the outer sections 24 are sized to accommodate most sizes of vehicles. The sides and upper portions of the capsule 16 are made of longitudinal pipes 26 which are braced by circular beams 28 to form a cage-like lattice-like structure in a generally cylindrical configuration. The bottom of each capsule 16 is provided with two large rectangular anti-friction pads 30 which extend the entire length of the capsule 16. The anti-friction pads 30 are located at the bottom of the capsule 16 and the entire weight of the capsule rests on the anti-friction pads 30. The pads 30 are mounted to a semi-cylindrical plate 220 secured to the underside of the capsule 16. Additional anti-friction pads 34 are mounted around the periphery of the circular beams 28. Each capsule has expandable ends 38 at opposite ends of the capsule 16. The expandable ends both include anti-friction pads 34 which aid in braking the train.

Figure 10:
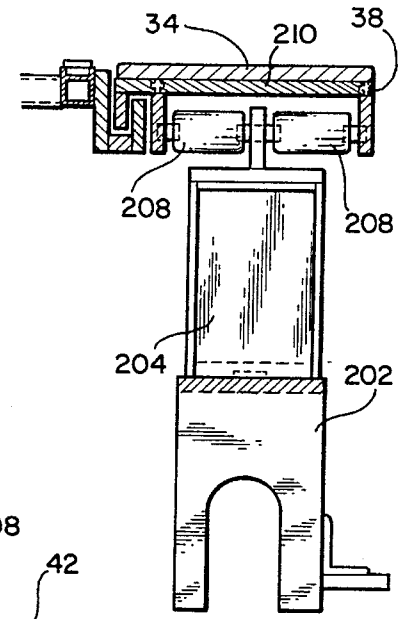
FIG. 10 is a detail of FIG. 8.
Figure 9:
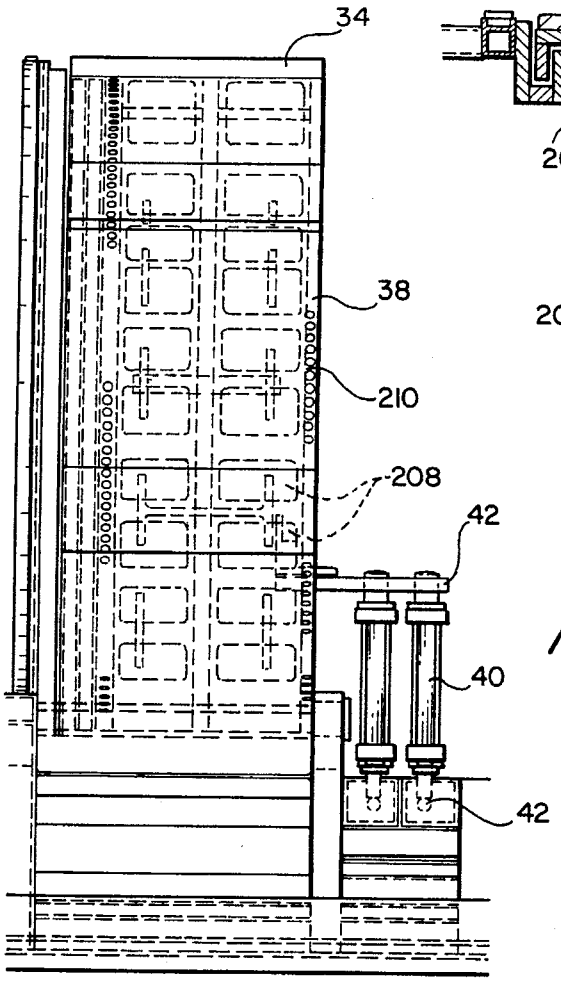
FIG. 9 is a detailed side elevational view of the end of the capsule of FIG. 3.
Figure 8:
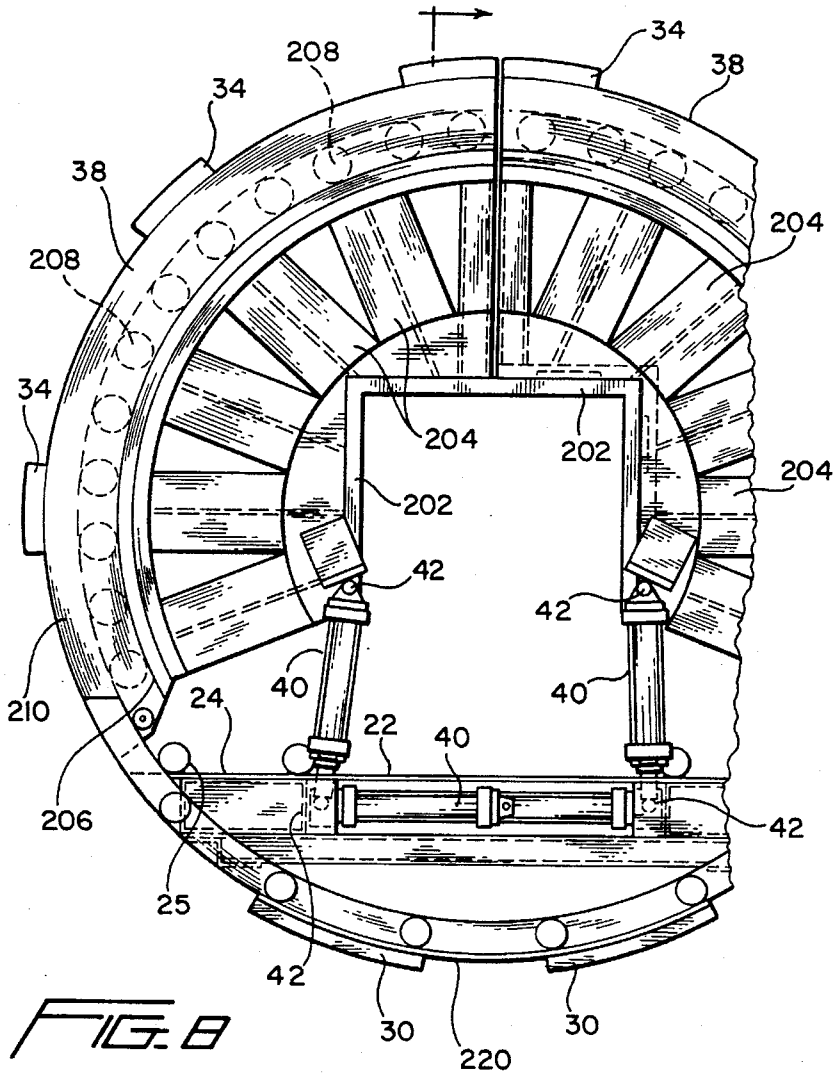
FIG. 8 is a detailed end view of the capsule of FIG. 3.
Figure 11:
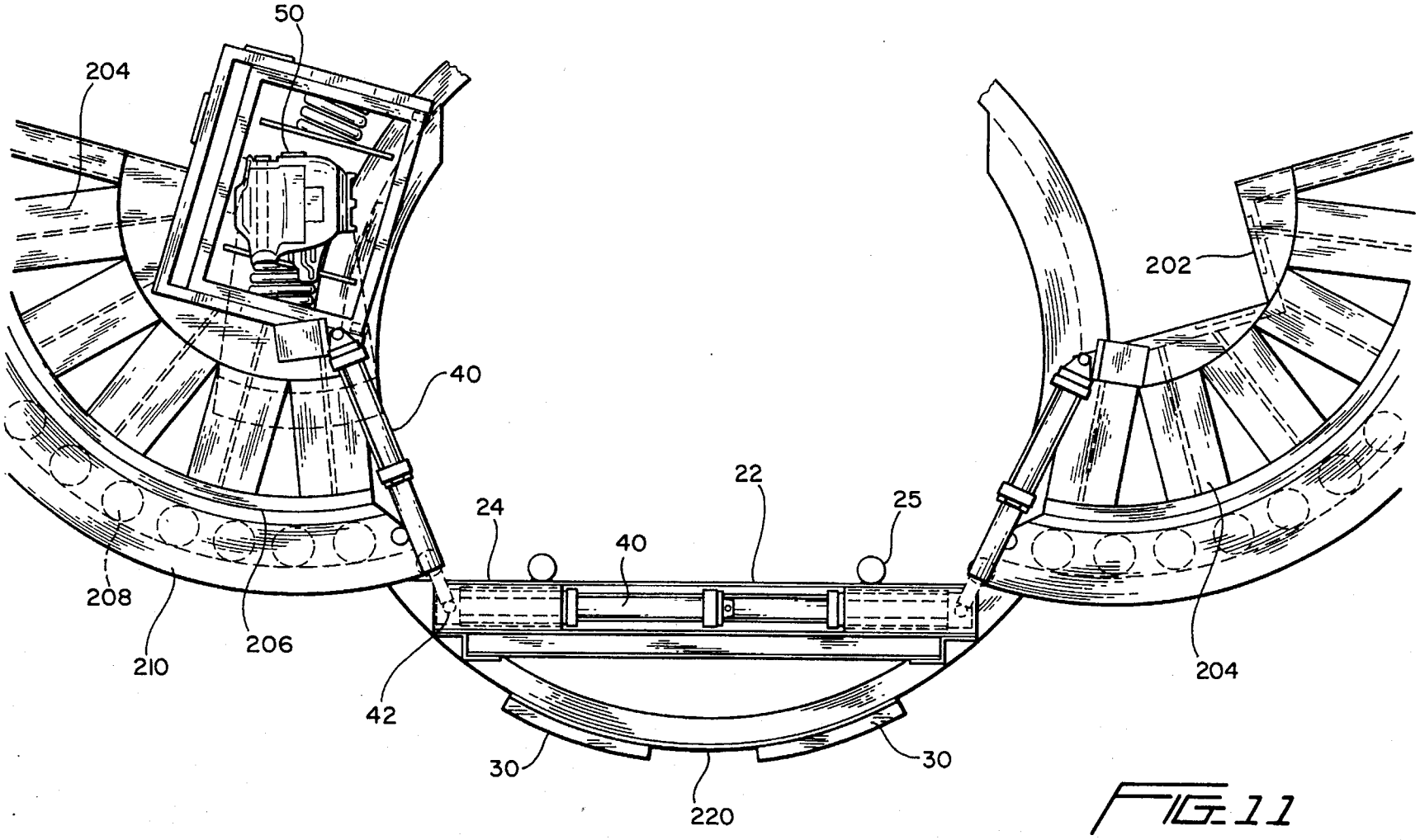
FIG. 11 is an end view of the capsule with the end assembly splayed open to provide access to the interior of the capsule.

FIGS. 8, 9, and 10 show details of the expandable ends 38. The expandable ends 38 include an inner frame 202 connected to a series of I-beams 204 which, in turn, are connected to an outer frame 206. A series of rubber cushions 208 are located between the outer frame 206 and the outer housing 210 of the expandable ends 38. Hydraulic pistons 40 are connected between the steel floor 22 of the capsule 16 and the frame 202 of the expandable ends 38. The expandable ends 38 are rotatable between a closed position (FIG. 8) and an open position (FIG. 11) around a series of pivots 42 in response to signals from the cab of the ram drive vehicle 18 by the system operator to open and close the expandable ends 38. It will be appreciated that the expandable ends 38 are opened in order to receive vehicles within the interior of the capsule 16. Once the capsule 16 is loaded, the operator will close the expandable ends 38 to secure the capsule. In case of emergencies the operator may splay the expandable ends 38 outwardly, causing the anti-friction pads 34 to contact bearing surfaces on the interior of the tunnel 12, thereby increasing friction to brake the train in addition to using reversal of the ram drive vehicle 18.

Figure 12:
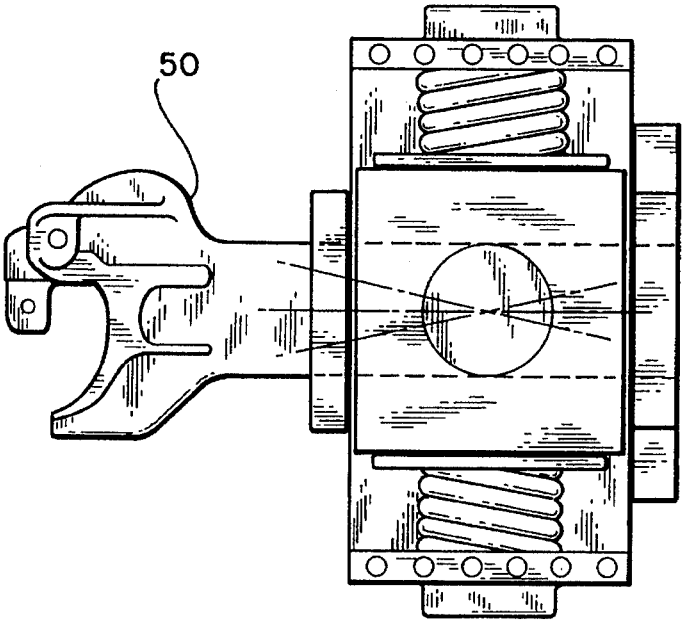
FIG. 12 is a top plan view of a coupler used with the present invention.
Figure 13:
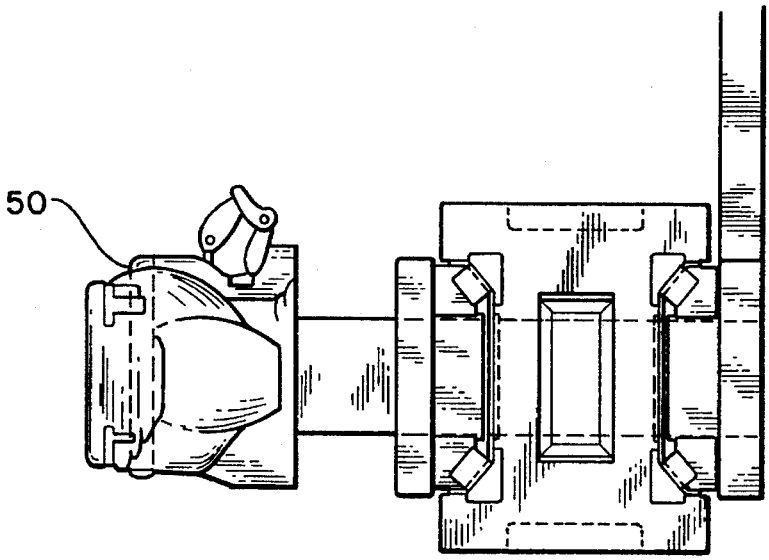
FIG. 13 is a side elevational view of the coupler of FIG. 12.

Each capsule 16 is provided with couplers 50, as shown in detail in FIGS. 12 and 13, which are mounted on blocks 220 on the expandable ends 38 of the capsule 16. Each coupler 50 is equipped with solenoid devices which permit remote control activation by the operator in the ram drive capsule 18. Preferably, the couplers 50 are standard railroad type couplers found on passenger and freight cars and connect the individual capsules 16 together to form the train. The couplers 50 include a plate carrier 222 and mounting springs 224. A counter balance 226 is mounted on the opposite side of the block 221 from the coupler 50 When the expandable ends 38 close, a coupler 50 mounted on an end of one of the capsules 16 is in position to firmly engage a coupler 50 on an adjoining capsule 16 to connect them together. Movement is permitted between the couplers 50, thereby allowing the capsules 16 to rotate on curves of the tunnel 12 while creating a pendulum motion to ensure a comfortable ride.

The capsule 16 is cylindrically shaped, and has no wheels. The anti-friction pads 30 on the bottom and the pads 34 mounted on the circular beams 28 around the outer periphery of the capsule 16, permit the capsule 16 to be propelled through the tunnel. The weight of the capsule 16 rests on the anti-friction pads 30, which extend the entire length of the capsule 16.

Electronically operated latch assemblies 51, which are used to connect the capsules 16 to turn-around apparatus in the transfer station, as described hereinbelow, are mounted under floor 22. A rack and pinion device 52 lifts and lowers a latch 53. Springs 54 connect the latch assemblies 51 to the capsule 16. There are two latch assemblies 51, one at each end of the capsule 16. When activated, latches 53 protrude through slots, not shown, cut in the plate 220 at the bottom of capsule 16, for engaging ground conveyers in the transfer station. Springs 54 cushion the impact when latch 53 is dropped.

FIGS. 14–20 show details of specially designed mechanisms which automatically lock the wheels of the automobiles in the floor of the capsule 16. Preferably, there would be five (5) mechanisms strategically placed on the floor 22 on each side of the capsule 16, making a total of ten (10) per capsule 16. The location of the front wheels of each vehicle being transported in the capsule 16 are controlled by the guide rails 25, which enable a driver to drive a vehicle in the center of the capsule 16 during loading and unloading and precisely position the vehicle. Suitable instructional devices, (not shown), indicate to the driver to stop at a precise position where the front wheels of the vehicle rest between locator pads 58.

Figures 14, 15, 16:
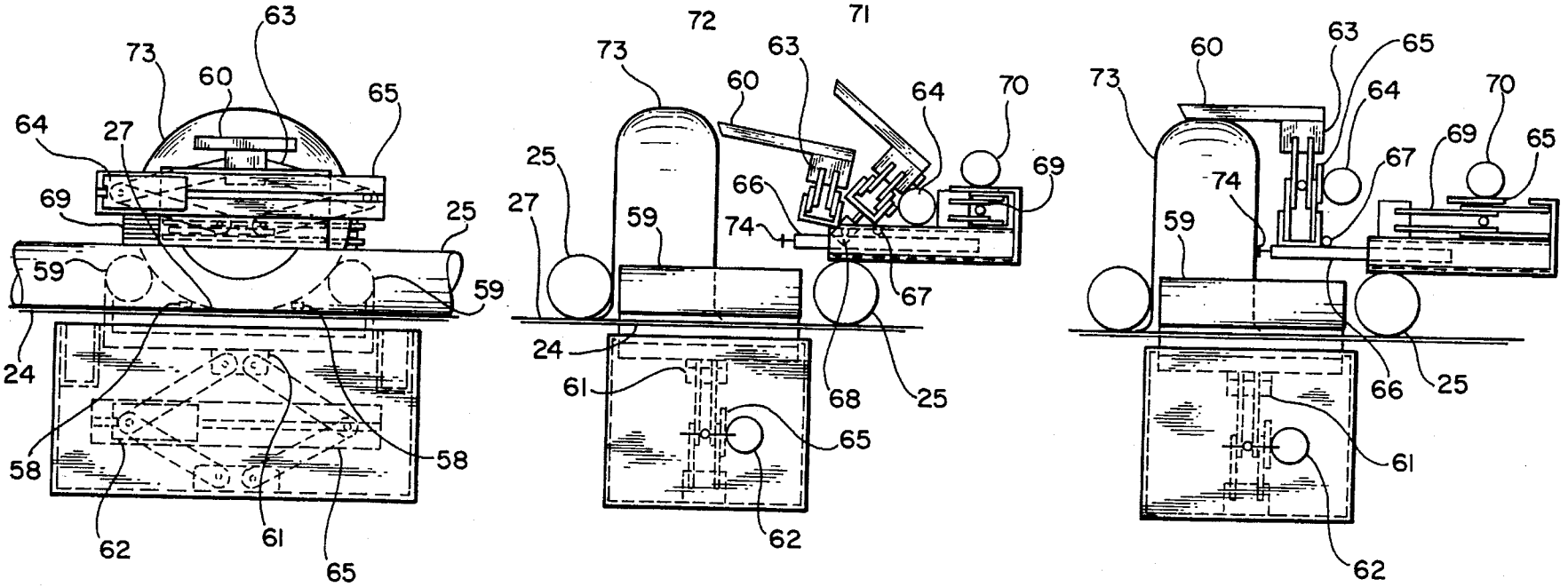
FIG. 14 is a side view of a locking mechanism securing a small wheel of a vehicle being transported in the capsule.
FIG. 15 is an end view of the locking mechanism of FIG. 14 in a partially secured position.
FIG. 16 is an end view of FIG. 14 in a fully secured position.
Figure 21:
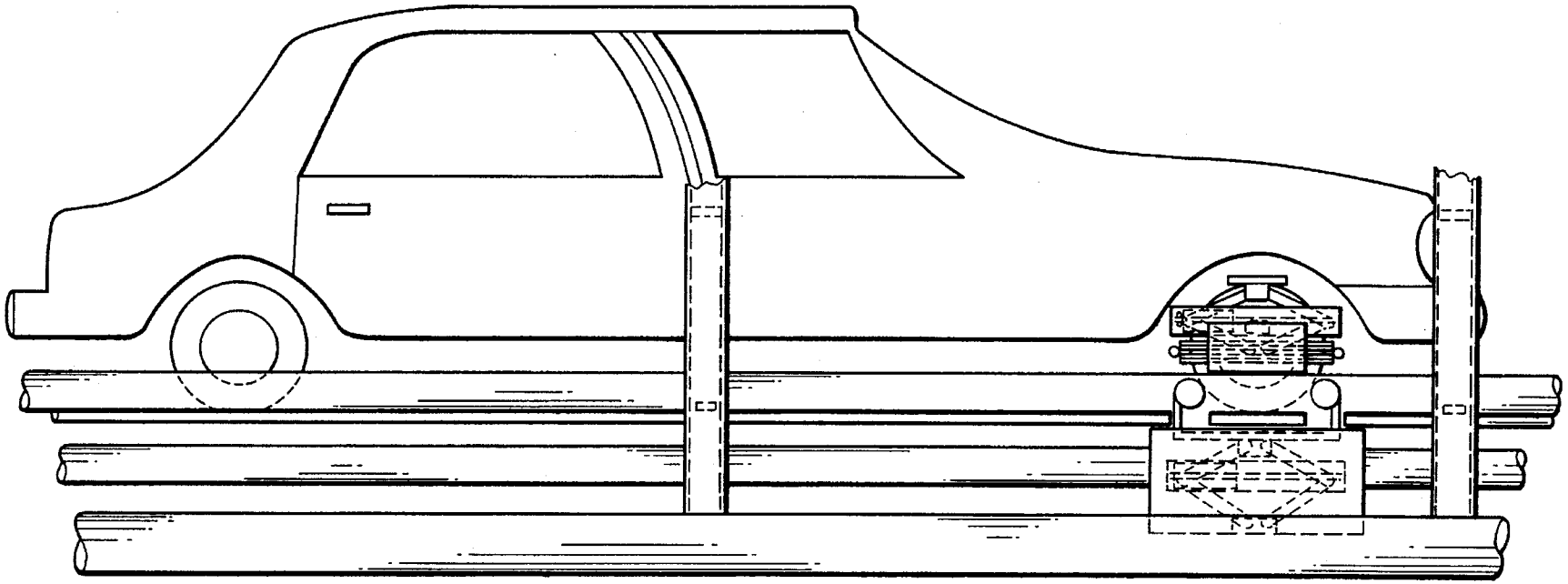
FIG. 21 is a side elevation view of a portion of the capsule showing an automobile front wheel fully secured in position by the locking mechanism of FIGS. 14–20.

FIGS. 14, 15 and 16 show the locking mechanism securing a small wheel of a vehicle being transported in the capsule. FIGS. 17–20 show the locking mechanism securing a large wheel of a vehicle being transported. FIG. 21 shows a vehicle V with its front wheel secured by a locking mechanism used with the present invention.

The front wheels are locked in position by wheel-bars 59 and caps 60. The wheel-bars 59 prevent the wheels from rolling back and forth while the caps 60 restrain vertical motion of the vehicle wheels. The wheel-bars 59 are raised into position by elevator jacks 61, activated by motors 62 installed under tracks 24. Slots 27 in tracks 24 allow each of the wheel bars 59 to raise simultaneously above the floor 22 until firm contact is established with the tires of the wheels.

The caps 60 are secured to jacks 63 equipped with electric motors 64. The motors 64 are secured on plates 65 which continuously keep the motor's head adjacent to the jacks trunnion. One end of plate 65 has a hole in which the pin of one of the jack's end fits, whereas the other end of the plate has a slot allowing a pin from the opposite end of the jack to slide through. The bases of the jacks are mounted on sliding platforms 66 which line up with the pads 58 upon which the front wheel tires have come to rest. The cap jacks 63 are secured to the platforms 66 through spring-loaded hinges 67 which allow the jacks to tilt and force them to return to the vertical position. The hinges are also equipped with solenoid-activated plungers 68.

Figure 19:
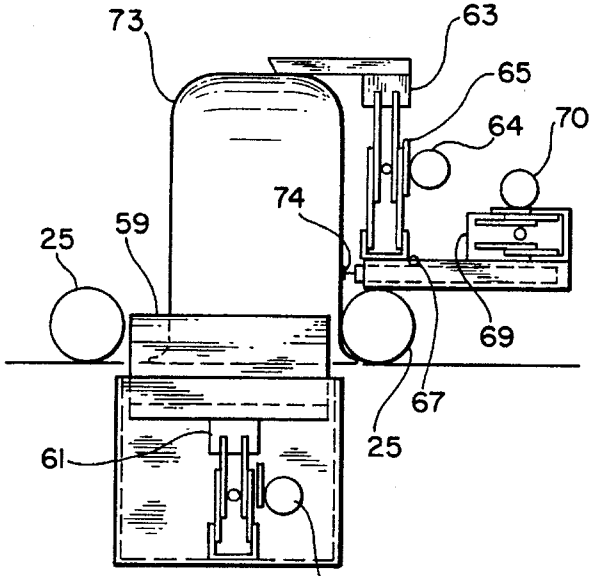
FIG. 19 is an end view of FIG. 17 in a fully secured position.
Figure 18:
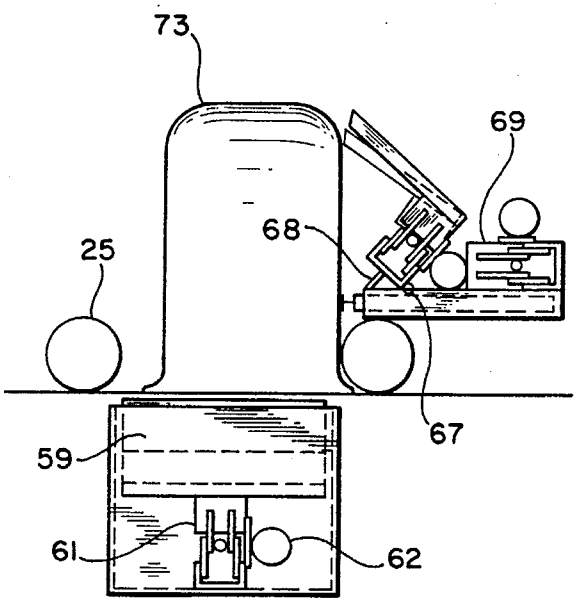
FIG. 18 is an end view of FIG. 17 in intermediate operative position.
Figure 20:
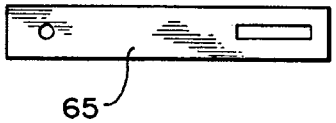
FIG. 20 is a view of plate used with the locking mechanism of FIG. 17.
Figure 17:
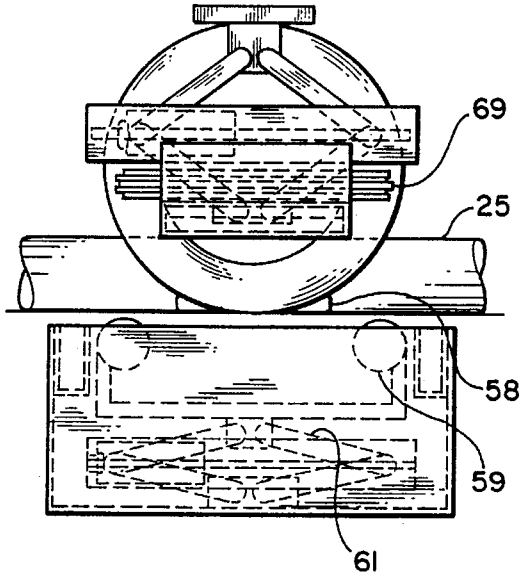
FIG. 17 is a side view of the locking mechanism securing a large wheel.

Since the securing devices are used in a minimum space, the caps 60 are tilted in the retracted position 71. To lock the wheels, the cap jacks 63 must approach the wheels and reach their tops. Lateral adjustment jacks 69 activated by electric motors 70 are used to slide platforms 66 toward tires 73. FIG. 15 illustrates the side motion of cap 60 from its resting position 71 to position 72 approaching tire 73 (farther away). As cap 60 touches tire 73 and continues to be pushed toward it by lateral jack 69, the cap is forced into an upward motion. The lateral jack 69, will continue to push the platform until limit switch 74 signaling the contact with tire 73 stops motor 70. This will energize motor 64 of jack 63 which raises the cap to the point where it covers the tire (FIG. 16 and FIG. 19). When the cap's jack 63 has reached the top of the tire, the spring-loaded hinge 67 will force cap 60 on top of the tire. Hinges 67 closes and the motor shuts off. The cycle has ended. To start the reverse cycle, solenoid 68 is activated tilting jack 63 with cap 60, thus releasing the tire.

FIGS. 22, 23 and 24 show a passenger capsule 80 which is used to transport people rather than vehicles. Instead of having a floor with guide rails, it is provided with passenger seats 82 and other amenities including rest rooms, and perhaps a snack bar to make the passengers ride more comfortable. Like the automotive capsule 16, the passenger capsule 80 includes an anti-friction bottom 84 and is also provided with circular beams 86 having anti-friction pads 88 around the periphery of the circular beam 86. Both ends of the passenger capsule 80 include expandable ends 38 of the same type shown in detail with reference to capsule 16. The expandable ends have the capability of being splayed outwardly to increase friction against the tunnel walls to brake the train. The purpose of this passenger capsule 80 is to accommodate passengers who prefer not to ride in their own cars and for passengers without vehicles arriving at the terminal in buses, taxi cabs or other types of transportation.

Figure 26:
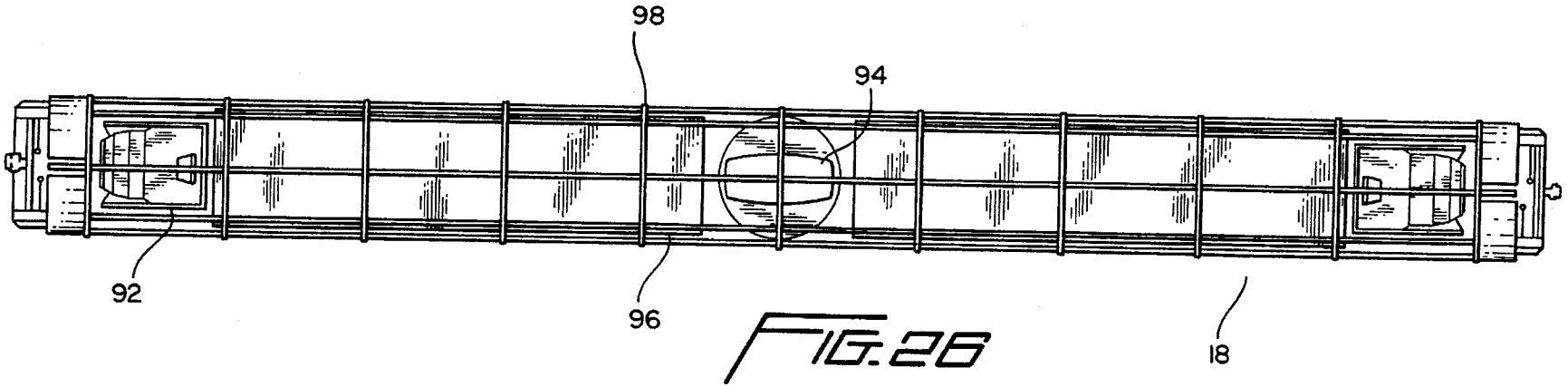
FIG. 26 is a top plan view of the ram drive vehicle of FIG. 25.
Figure 25:
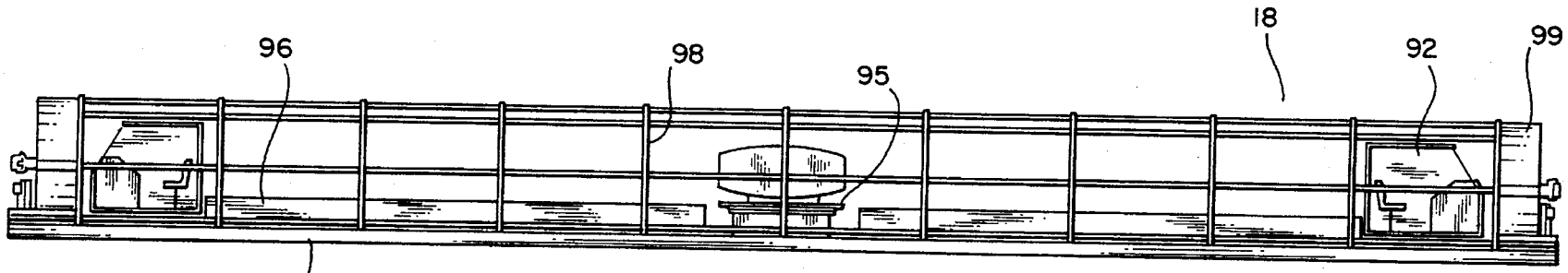
FIG. 25 is a side elevation view of a ram drive vehicle used with the transportation system of the present invention.

FIGS. 25 and 26 illustrate a ram drive vehicle 18 including an operator cab 92, a jet engine 94 mounted on turntable 95 for two-directional operation and fuel tanks 96. The ram drive vehicle 18 is provided with a large anti-friction pad 97 on the bottom of the vehicle and the entire weight of the vehicle rests on the anti-friction Pads 97. Additional anti-friction Pads 98 are mounted around the periphery of circular beams similar to the capsule construction. It will be appreciated that the ends 99 of the ram drive vehicle 18 are identical to the expandable ends 38 of capsule 16 including couplers 50 which are compatible with complementary couplers 50 on the ends of the capsules 16 and capsules 80 which form the train. The ram drive vehicle 18 propels the capsules 16 and 80 which make up the train through the tunnel with the force of the jet engine 94, allowing the drive vehicle 18 and the capsules 16 and 80 to ride through the tunnel on the anti-friction surfaces of the train and the interior of the tunnel.

Figure 27:
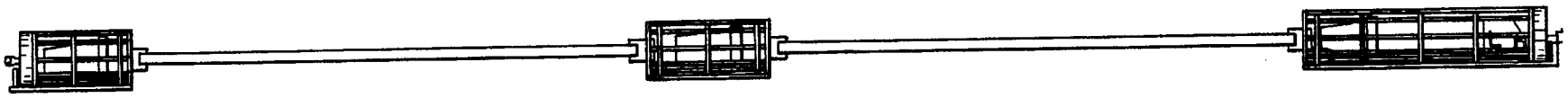
FIG. 27 is a side elevational view of an alternate ram drive vehicle using three engines.
Figure 28:
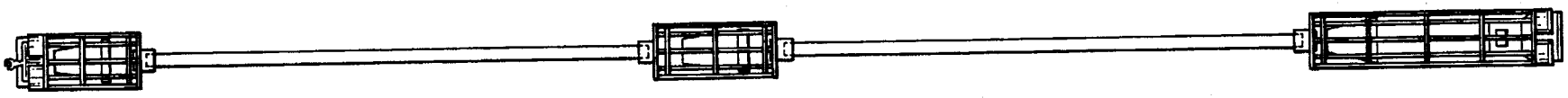
FIG. 28 is a top plan view of the ram drive of FIG. 27.

FIG. 27 illustrates an alternate ram drive vehicle 300 having an operator cab 302 and three jet engines 304. Suitable connector rods 306 having high strength and heat withstanding ability connect the auxiliary jet engines to the operator cab 302. The additional jet engines allow the formation of larger and heavier trains.

Figure 29:
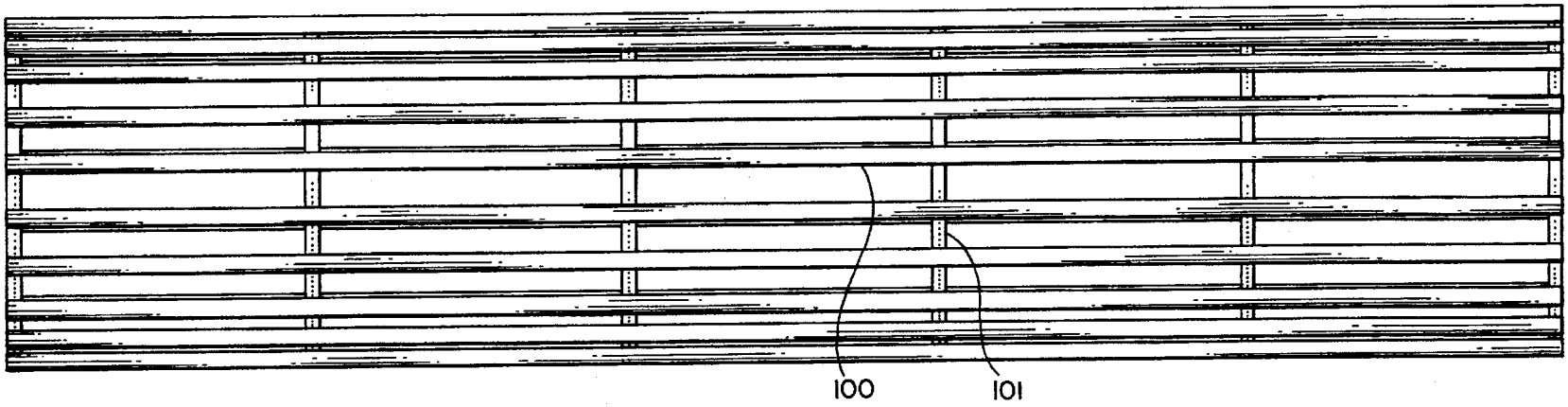
FIG. 29 is a detail of a section of the self-supporting tunnel used with the present invention.
Figure 30:
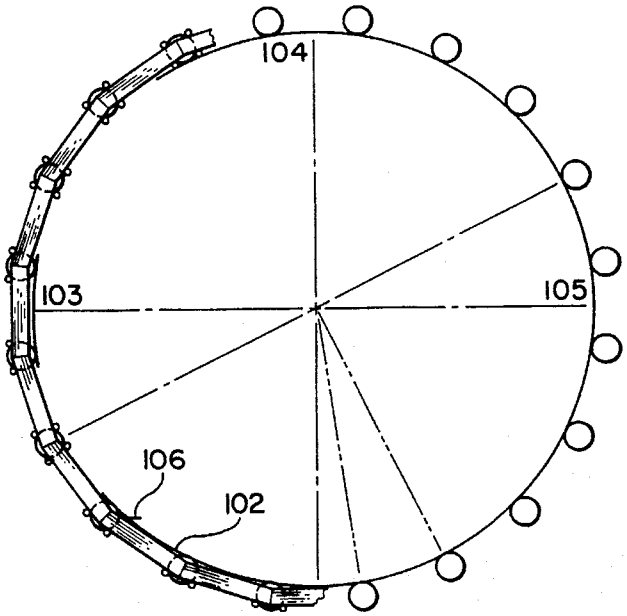
FIG. 30 is an enlarged end view of the tunnel section of FIG. 29.
Figure 31:
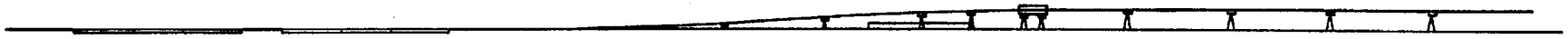
FIG. 31 is an elevation view of a typical transfer station used with the transportation system of the present invention.
Figure 32:
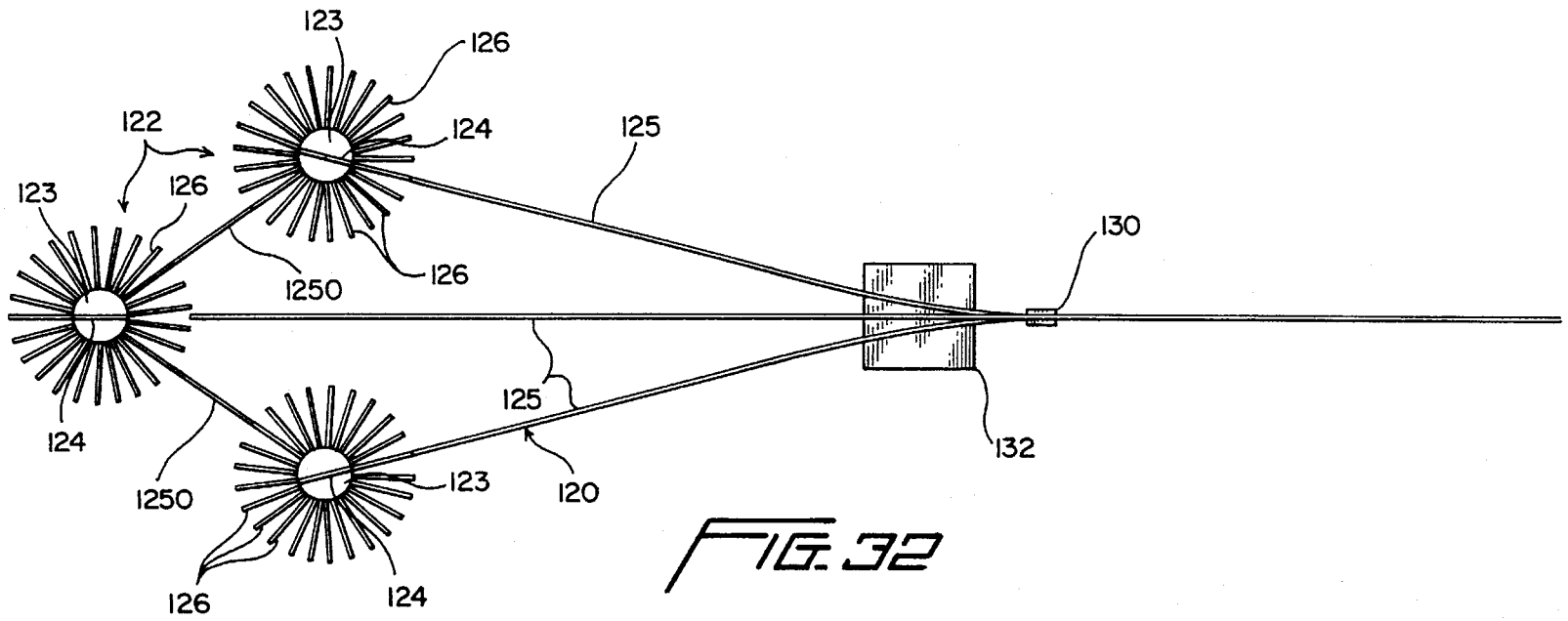
FIG. 32 is a top plan view of the station of FIG. 31.
Figure 33:
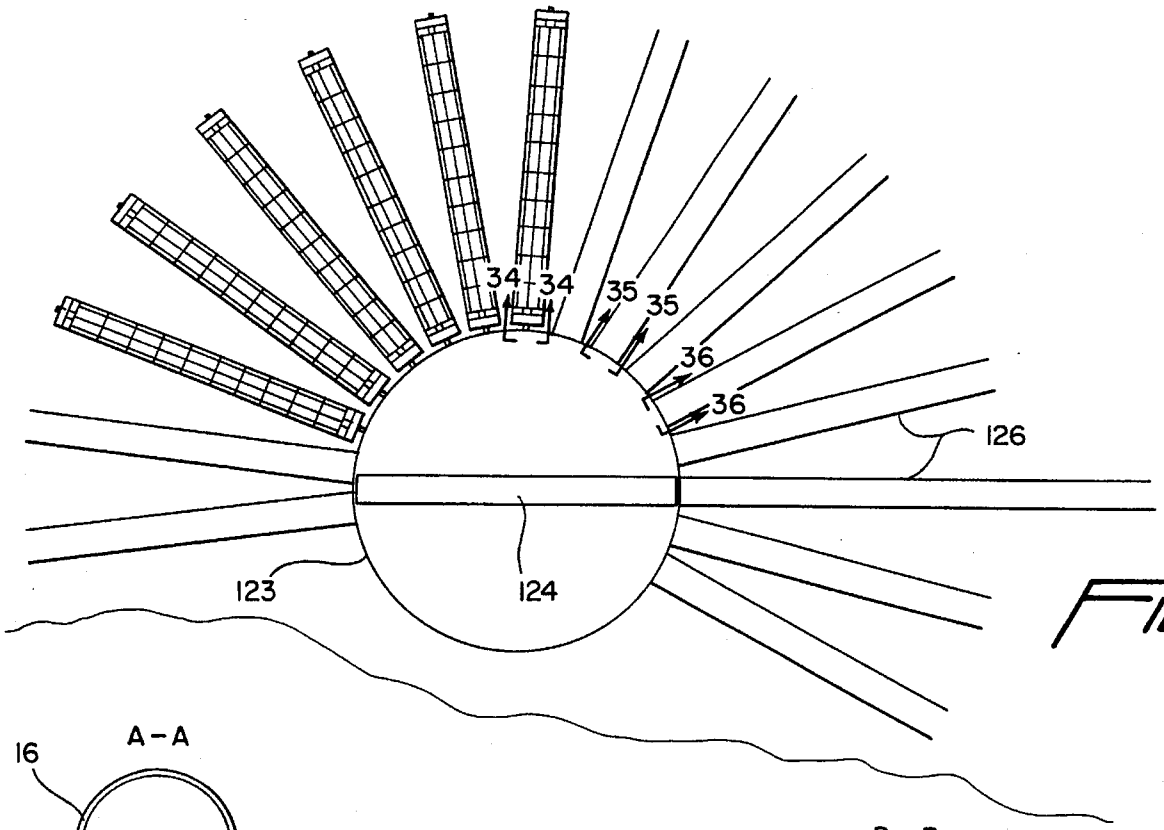
FIG. 33 is a view of a detail of the transfer station of the present invention.
Figure 35:
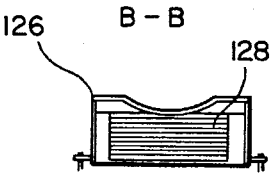
FIG. 35 is a sectional view taken along the line 35—35 of FIG. 33.
Figure 34:
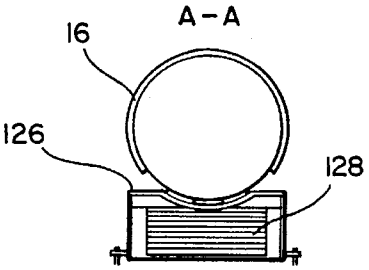
FIG. 34 is a sectional view taken along the line 34—34 of FIG. 33.
Figure 36:
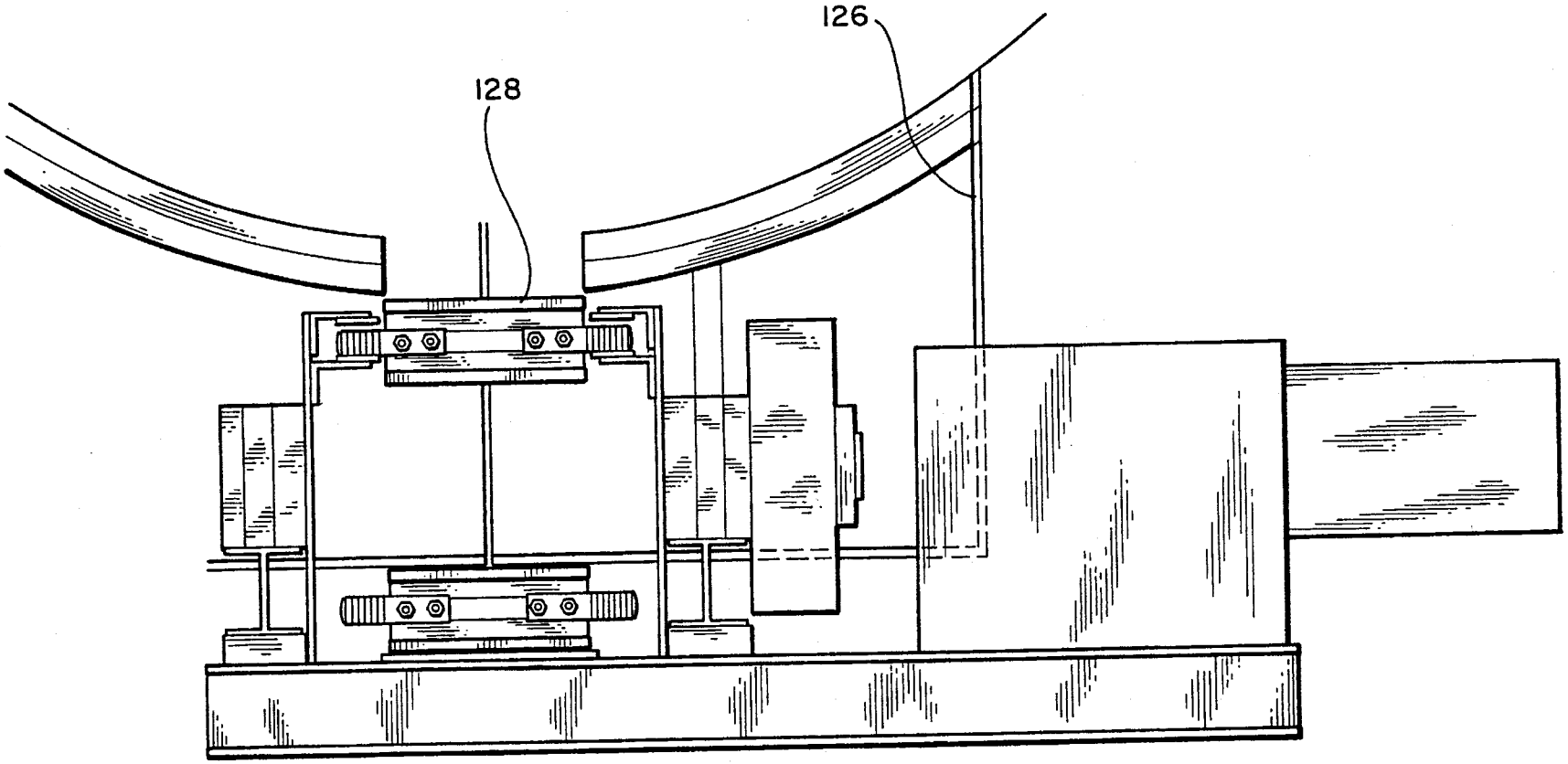
FIG. 36 is a sectional view taken along the line 36—36 of FIG. 33.

Referring to FIGS. 29 and 30, a detail of the self-supporting tunnel 12 is shown. The tunnel 12 is made with a slightly larger diameter than the capsules 16 and 80 and ram drive vehicle 18. The tunnel 12 is made of longitudinal pipes 100 which extend longitudinally for the length of the system and which are braced by circular beams 101. Reinforcement plates 102, 103, 104, and 105 are connected to the interior surfaces of the tunnel 12 and also extend longitudinally the length of the system. The lower plate 102 provides a bearing surface for the train members to ride upon a smooth riding surface. Lower plate includes stop members 106 in order to maintain the train upright as it travels through the tunnel 12. The other plates 103, 104, and 105 provide additional structural reinforcement to the tunnel 12 as well as providing a smooth riding surface for the anti-friction pads around the periphery of the train. These plates also form a bearing surface for the anti-friction pads on the expandable ends of the individual train units.

FIGS. 31–36 show a typical transfer station 120 which is used for loading, positioning and transfer of the capsules 16 and 80 into the tunnel. The transfer station 120 includes a series of radial loading positions 122. Each loading position 122 includes a centrally positioned turntable 123 having a trough 124 sized to receive a vehicle or passenger capsule enabling it to be rotated by the turntable 123. Access tracks 125 connect each radial loading position 122 between a pay station 132 and turnout 130 for access to the tunnel system. Capsules which are used to form the train, such as vehicle capsules 16 or passenger capsules 80, are located at a radial loading position 122 and are positioned within metal troughs 126 shown in detail in FIGS. 34, 35 and 36. The troughs 126 are disposed radially with respect to each turntable 123. A conveyor 128 is installed inside each metal trough 126. It will be appreciated that each radial loading position when occupied by a capsule will provide ground level access for the automobile's loading and unloading.

A train is formed by positioning a ram drive vehicle in alignment with an access track 125 on an opposite side of a turntable 123. The turntable 123 is rotated until its trough 124 is aligned with a loaded train capsule located on one of the radial troughs 126, which has been loaded with vehicles or passengers. At that point, the latch assembly 51 on a capsule is lowered causing the latch 53 to engage the conveyor 128 mounted below. When the conveyor 128 is activated, the capsule is driven forwardly by the conveyor 128, allowing it to slide onto the turntable 123. The turntable 123 then is rotated in alignment with the exit position at the access track 125. A conveyor (not shown), inside turntable trough 124, transfers the capsule onto the access track 125 and it becomes the first capsule to form the train. The couplers 50 on each capsule automatically engage as the capsules meet. Conveyors 128 inside the troughs keep moving the capsules up the ramp. This process is repeated until a complete train is formed. Gradually all capsules will reach the turnout 130 leading to the tunnel. The loading operation may be controlled by the operator in the ram drive vehicle 18 or by a ground operator located at the traffic control tower next to the turntables. The ram drive vehicle 18 arriving with a string of capsules, leaves them on one of the access tracks 125 where the conveyors in the troughs will start pushing them onto the turntable. The ram enters another access track 125, slides onto a turntable and through access track 1250 reaches the turntable in back of a newly formed train, meets the last capsule of train and pushes the train forward through the tunnel and gradually increasing speeds to the selected destination.

When the train arrives at the destination yard, the above described sequence is repeated in reverse. The ram drive vehicle 18 disengages the train and the capsules are moved by conveyor 128 to a turntable 123 for positioning. The ground operator activates the turntable motor to align it with a desired parking location. Once in parked position, the operator remotely opens the expandable ends. The operator then remotely rotates the turntable to the yard position after which the next capsule is pushed onto the turntable to repeat the first operation. The vehicles and passenger depart from the individual capsules and the capsules are ready for reloading to another or return destination.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A high speed transportation system comprising: a self-supporting tubular conduit and a train, said train formed of a plurality of units, including at least one transport capsule and a drive vehicle for propelling the train through said tubular conduit;

said conduit including longitudinal bearing surfaces extending the length thereof;

said transport capsule and said drive vehicle including anti-friction bearing members formed on outer surfaces thereof and structured to engage said longitudinal bearing surfaces on said conduit;

said longitudinal bearing surfaces and said anti-friction bearing members being complimentary and aligned for guiding said train through said conduit; and, said longitudinal bearing surfaces being further defined by having a concave shape corresponding to the inner diameter of said tubular conduit and said anti-friction bearing members being further defined by having a semi-hemispherical convex shape for cooperation with said longitudinal bearing surfaces.

2. The system of claim 1 wherein said longitudinal bearing surfaces of said conduit include a first semi-hemispherical bearing surface along a bottom inner periphery thereof and at least two second semi-hemispherical bearing surfaces along a side inner periphery thereof.

3. The system of claim 1 wherein said capsule is provided with an end structure which is expandable between a closed and open position to provide access to the interior of said capsule.

4. The system of claim 3 wherein said expandable end structure includes a hydraulic actuator for operation thereof between said open and closed positions, permitting access to an interior portion of said capsule.

5. The system of claim 1 wherein said capsule includes an end structure having anti-friction bearing members on outer surfaces thereof, whereby opening said end structure when said capsule is moving through said conduit provides a braking action between said anti-friction bearing members on said end structure and said longitudinal bearing surfaces.

6. The system of claim 1 wherein said drive vehicle includes a jet engine and operator cab.

7. The system of claim 6, including a plurality of transport capsules.

8. The system of claim 7, further including a coupler assembly between each of said transport capsules and said drive vehicle for coupling the same together, forming said train.

9. The system of claim 1 further including road vehicle storing means in said capsule for storing road vehicles during the transportation of said capsule through said conduit.

10. The system of claim 9 further including securing means for keeping the wheels of said road vehicles in place including a pair of wheel-locking bars for at least one wheel and a cap for clamping said one wheel and preventing horizontal and vertical motion thereof during the transportation mode.

11. The system of claim 10 further including elevator jacks and actuating motors for positioning said wheel bars and said caps in position against the wheels of said road vehicles.

12. The system of claim 11 further including cap jacks to raise and lower said caps and spring loaded hinges to tilt the caps away from a vehicle wheel to be secured while the wheel is being positioned and means for releasing said hinges when said caps are properly positioned to secure the caps to said vehicle wheel.

13. The system of claim 12 further including limit switches for automatically controlling the movement of said locking bars and said caps.

14. The system of claim 1 further including a transfer station for loading and unloading said capsules.

15. The system of claim 14 wherein said transfer station includes at least one loading position having a turntable and a series of radially positioned troughs surrounding said turntable whereby said turntable is rotatable to load and unload said capsules into and out of selected ones of said troughs.

16. The system of claim 15 wherein said troughs further include conveyors for transferring said capsules.

17. A high speed transportation system comprising: a self-supporting tubular conduit and a train, said train formed of a plurality of units, including at least one transport capsule and a drive vehicle for propelling the train through said tubular conduit;

said conduit including longitudinal bearing surfaces extending the length thereof;

said transport capsule and said drive vehicle including anti-friction bearing members formed on outer surfaces thereof and structured to engage said longitudinal bearing surfaces on said conduit;

said longitudinal bearing surfaces and said anti-friction bearing members being complimentary and aligned for guiding said train through said conduit; and, said capsule including an expandable end structure, moveable between a closed and open position to provide access to the interior of said capsule, said end structure having anti-friction bearing members on outer surfaces thereof cooperating with said longitudinal bearing surfaces; whereby opening said end structure when said capsule is moving through said conduit provides a braking action between said anti-friction bearing members on said end structure and said longitudinal bearing surfaces.

18. The system of claim 17 wherein said expandable end is further defined by having two semi-circular sections pivotally attached to a frame portion of said capsule and actuating means for pivotally moving said expandable end sections between an open and closed position.

19. The system of claim 18 wherein said actuating means are hydraulic cylinders.

20. The system of claim 17 wherein said longitudinal bearing surfaces are further defined by having a semi-hemispherical concave shape corresponding to the inner diameter of said tubular conduit and said anti-friction bearing members being further defined by having a semi-hemispherical, convex shape for cooperation with said longitudinal bearing surfaces.

* * * * *